United States Patent [19]

Mazelie

[11] Patent Number: 5,035,250

[45] Date of Patent: Jul. 30, 1991

[54] CIGARETTE-LIGHTER WITH BUILT-IN EXTINGUISHER DEVICE

[76] Inventor: Yves Mazelie, Les Remparts, Place du Vieux Château, 02460 La Ferte Milon, Aisne, France

[21] Appl. No.: 378,939

[22] Filed: Jul. 12, 1989

Related U.S. Application Data

[63] Continuation-in-part of Ser. No. 168,492, Mar. 15, 1988, abandoned.

[30] Foreign Application Priority Data

Feb. 26, 1988 [EP] European Pat. Off. ..... 88400449.0

[51] Int. Cl.[5] ..... A24F 13/18

[52] U.S. Cl. ..... 131/256; 131/235.1; 431/146

[58] Field of Search ..... 131/256, 235.1; 431/146, 157

[56] References Cited

U.S. PATENT DOCUMENTS

| | | | |
|---|---|---|---|
| 4,033,926 | 7/1977 | Anderson | 523/456 |
| 4,141,880 | 2/1979 | Nametz et al. | 524/411 |
| 4,478,230 | 10/1984 | Mazelie | 131/235.1 X |
| 4,886,076 | 12/1989 | Gilbert et al. | 141/235.1 X |

*Primary Examiner*—V. Millin
*Assistant Examiner*—Jennifer L. Doyle
*Attorney, Agent, or Firm*—Browdy and Neimark

[57] ABSTRACT

The cigarette-lighter with built-in extinguisher device includes a cup having an inner wall of revolution ending into a vault. The inner wall of this cup is polished and has an inlet (*9a*) of a diameter corresponding substantially to that of a cigarette. The cup is fixedly connected to the bottom of a body of the cigarette-lighter. The bottom of the cup includes a substantially hemispherical vault having spherical sectors connected by a plane portion.

41 Claims, 1 Drawing Sheet

CIGARETTE-LIGHTER WITH BUILT-IN EXTINGUISHER DEVICE

This is a continuation-in-part of parent copending application U.S. Ser. No. 07/168,492 filed Mar. 15, 1988, now abandoned, the contents of which are incorporated herein.

BACKGROUND OF THE INVENTION

It is known that a great number of fires are caused by smokers who are in habit of throwing cigarette-ends which are not extinguished. Events in the past few years have shown that this bad habit creates catastrophic disasters reaching the dimension of a real plague responsible for a destruction of innumerable acres-of forests, and which are also responsible of very serious accidents in urban areas.

In order to fight the reflex gesture of most smokers which consists in throwing away their cigarette-ends which are not extinguished, it seems essential to progressevely create for the smoker a new habit to extinguish his cigarette before throwing it away and, for so doing, to provide an article prompting the smoker to use this article due to its novelty as such.

Yet, it has been established that in order to create little by little such a new habit, it is indispensable that the article for extinguishing the cigarettes prior to their throwing away will not be expensive or at least that the price be reasonable enough not to hinder the presently existing commercialization of disposable-type cigarette-lighters.

In fact, the present inventor has engaged in a determined struggle against the plague represented by accidents caused by smokers. In order to lead smokers to adopt the habit of extinguishing their cigarette butts before discarding them, the present inventor has determined that it is necessary that smokers have permanently at their disposal a suitable and effective means. While certain of the known prior art have the objective, they have not provided a satisfactory means.

OBJECTS OF THE INVENTION

Therefore, the invention provides a new cigarette-lighter with built-in extinguisher device of a so simple design and so efficient that it can be produced in very large quantities without greatly modifying the cost price of disposable cigarette-lighters presently on the market.

On the other hand, the invention is such that the general appearance of the cigarette-lighter is not changed, so that the portion forming the extinguisher does not change the aesthetics of the cigarette-lighter nor the possibility of laying it down in the same manner as an ordinary disposable cigarette-lighter.

Moreover, and since smokers are generally in an habit of handling their cigarette-lighter between their fingers, the extinguisher device appears to them clearly and prompts them to use it, which tends to induce in them and little by little the habit reflex which is desired.

The invention enables an entirely automated production.

It is only by a selective choice of various important parameters and features that the inventor provides a construction which not only works well, but which is acceptable to the art. The inventor by his construction has actually achieved the interest of the international cigarette lighter manufacturers. To do so, there are a set of criteria which are achieved only by the present invention, these criteria including:

(1) The adoption of the cigarette extinguisher to the cigarette lighter must be as inexpensive as possible in order not to penalize it with respect to a conventional cigarette lighter.

(2) The volume occupied by the extinguisher must be reduced in order not to significantly decrease the number of cigarettes lightable by a disposable cigarette lighter.

(3) The extinction of the cigarette must be instantaneous or almost instantaneous in order not to risk to have the fuel of the lighter overheated.

(4) The depth of the extinguisher must be reduced to a minimum in order to extinguish even the shortest of cigarette butts.

(5) The aesthetics of the cigarette lighter must not be altered or modified by the inclusion of the extinguisher.

(6) It must be clear and demonstrated that the extinguisher can be easily manufactured at the industrial level.

A cigarette lighter according to the present invention is a perfect and complete response to all the above criteria.

BRIEF DESCRIPTION OF KNOWN PRIOR ART

Applicant has already disclosed in U.S. Pat. No. 4,478,230 a lighter forming an extinguishing ash tray in which the lighter comprises a chamber for receiving ashes of cigarettes or cigars, said chamber having at least one wall formed by a portion of the body of the lighter and comprising an opening bored in a wall of the body and normally closed by a flap beneath which is mounted an apertured grate.

However, in above U.S. Pat. No. 4,478,230, the chamber 6 is provided to form an extinguishing ash tray and is not sized to fit the end of a cigarette, and so there is considerable oxygen within the chamber.

There is however known by French patent 77 06672, published under No. 2,382,205, a cigarette lighter which is designed for extinguishing a cigarette by lack of oxygen in a chamber having a frusto conical shape.

However in the above French patent, the end of the chamber is flat and, therefore, there is an annular zone containing oxygen when the end of the cigarette abuts the end of the chamber, and this annular zone of oxygen is eliminated only by jamming (forcing) the end of the cigarette against the end of the chamber with the result that the lit part of the cigarette is forced into the body thereof, the cigarette becomes at least partially crushed on the flat end, and the ashes fall down along and out of the tapered opening. Moreover the incandescent portions of the cigarette strongly heats the flat surface of the end of the chamber, which can be harmful particularly if the body of the cigarette-lighter is made of plastics.

In fact, the chamber of the above French patent is, as stated page 1, line 20, provided for "extinguishing and storing one (or a plurality) of butts . . . ", and the chamber is therefore long enough for storing these butts.

Furthermore, the chamber in the above French patent is sized so that its open end is wide enough to insert the cigarette without difficulty. Actually, the open end or inlet of the chamber has a diameter substantially larger than that of the cigarette. Therefore, the side wall of the chamber cannot cause squeezing and compaction of initially incandescent portions of the cigarette. As a consequence, a scattering of ashes will occur after extinction.

SUMMARY OF THE INVENTION

It is accordingly an object of the present invention to provide a construction of a cigarette lighter forming a cigarette extinguisher, comprising a capsule delimiting a cup shaped recess having a substantially hemispherical vault.

Another object is to provide such a capsule with an inner wall which constitutes means for squeezing and compaction of the initially incandescent portions of a cigarette in order to prevent a scattering of ashes after extinction.

A further object is to provide a construction having a capsule with a polished wall.

Still another object of the invention is to provide a construction wherein at least one cross section of the capsule corresponds substantially to the size of a cigarette.

A still further object is to provide a construction wherein the capsule has a depth of only 5–15 mm.

Still another object is to provide a construction in which the capsule has lateral wall so shaped to prevent the incandescent portions of the cigarette to contact the end of the capsule.

A cigarette lighter forming a cigarette extinguisher according to the invention comprises a capsule defining a cup-shaped recess having an inner wall of frustoconical revolution constituting means to cause a squeezing and compaction of initially incandescent portion of a cigarette in order to prevent a scattering of ashes after extinction, said capsule ending into a substantially hemispherical vault, said inner wall of said capsule being polished and having at least one cross section diameter corresponding substantially to that of a cigarette, and said capsule being fixedly connected to a bottom of a body of said cigarette-lighter and having a depth of 5–15 mm.

Various other features of the invention will become more apparent from the following detailed description.

BRIEF DESCRIPTION OF THE DRAWINGS

Embodiments of the invention are shown by way of non limiting examples in the accompanying drawings, wherein.

DETAILED DESCRIPTION OF THE INVENTION

Figure 1:
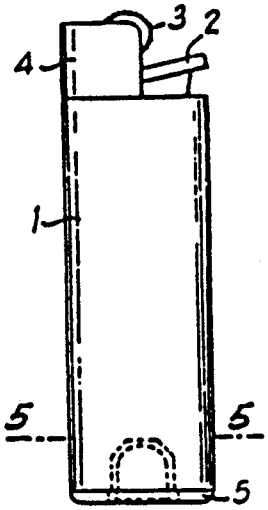
FIG. 1 is a side elevation view of a disposable cigarette-lighter making use of the invention.
Figure 2:
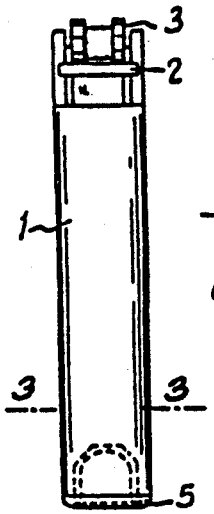
FIG. 2 is an elevation view of the cigarette-lighter of FIG. 1, but turned by 90°.

FIGS. 1 and 2 show in elevation a cigarette-lighter having a body designated generally at 1 and made for example of a synthetic material, by injection moulding or any other process.

In a known manner, the cigarette-lighter includes a trigger 2, a knurled wheel 3 and a flame-arrester 4 which are provided at one end of the body 1 forming a tank for a fuel, and typically a liquefied gas.

The bottom 5 of the cigarette-lighter comprises an insert 5*a*, for example forcibly engaged and possibly welded inside the inner wall of the body 1. In order to ensure a good closing, it is advantageous that the insert 5*a* has, substantially, the form of a bushing extending into the body 1 as shown in FIG. 3.

The insert 5 can be made of the same material as the body 1 or of a different material, this being often preferred when the insert 5*a* has to withstand relatively high efforts. Polyamides are a material particularly well adapted for making the insert 5*a*.

Figure 3:
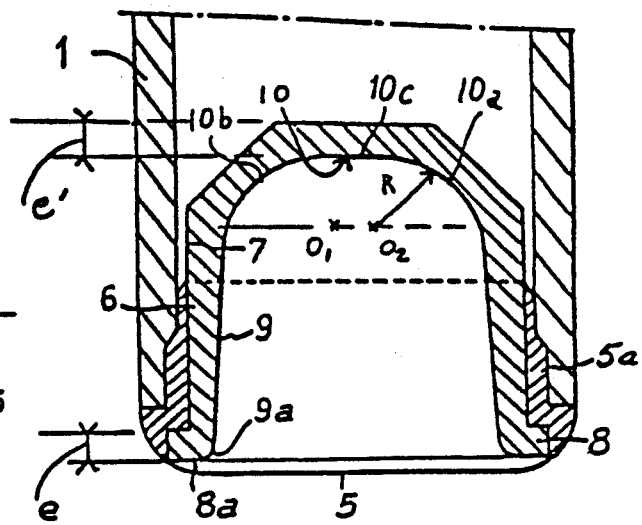
FIG. 3 is an enlarged cross sectional view taken substantially along line, III—III of FIG. 2.

As shown in FIG. 3, the insert 5*a* is provided in its median portion with a capsule 6 delimiting a cup shaped recess designed for forming an extinguiher for the incandescent portion of a cigarette to be inserted in the capsule 6. Therefore, the insert 5*a* should preferably be made of a heat insulating material, in order not to interfere with the material of the body 1.

The capsule 6 is preferably made of plastics material, but it can be made of metal, for example of aluminum. The capsule 6 outwardly defines a wall 7 which is substantially cylindrical and engaged with a force fit inside the bushing-shaped insert 5*a* to which it is rigidly connected. A flange 8 is formed in order to limit the length of introduction of the cup 6, and the bottom portion 8*a* of the flange 8 is either flush or short of the lowermost portion 5*b* of the bottom 5 in order that the cigarette-lighter can be placed on its bottom 5 and remain stable without the capsule 6 forming a protrusion which would possibly make it out of balance.

In this respect, the flange 8 has an outer diameter which is preferably within the range of 8 to 15 mm, more preferably between 9.5 and 13 mm and, the most preferably, the outer diameter of the flange 8 is equal to 11 mm. Samely, the thickness e of the flange 8, which is substantially equal to the general thickness e′ of the capsule 8, is preferably within the range of 0.5 to 2 mm, more preferably between 0.8 to 1.5 mm and, the most preferably, the thickness e and e′ are equal to 1 mm.

An inner wall 9 of the capsule 6 is first of a cylindrical shape, or preferably of a slightly frustoconical shape as shown, and is then in the shape of a substantially hemispherical vault as shown generally at 10.

It is also important that the inner wall at the base of the frustoconical portion is rounded as shown at 9*a*.

In this respect the radius of the part 9*a* is preferably within the range of 0.2 to 1 mm, more preferably between 0.4 and 0.8 mm and, the most preferably, this radius is equal to 0.5 mm.

As shown, the vault 10 defines two spherical sectors 10*a*, 10*b* centered respectively in $0_1$,$0_2$ and connected by a plane portion 10*c*.

Such a substantially hemispherical shape of the end of the capsule 6 enables to reduce the volume of oxygen contained in the cup shaped recess relatively to a flat end.

In this respect the radius R of the spherical sectors 10*a*, 10*b* is preferably within the range of 3 to 4 mm, more preferably between 3.4 and 3.8 mm and, the most preferably, the radius R is equal to 3.5 mm. Samely, the distance $0_1$ $0_2$ is preferably within the range of 0 to 1.8 mm, more preferably between 0.5 and 1.5 mm and, the most preferably, the distance $0_1$ $0_2$ is equal to 1 mm.

The inner size of the capsule 6 is chosen such that it has at least one cross section of a diameter which corresponds substantially to the diameter of a cigarette, and the conical shape of the inner wall 9 is chosen in order to meet with diameter differences in cigarettes of differents brands.

In this respect the diameter at inlet of the capsule 6 is preferably within the range of 8 to 9.5 mm, more preferably between 8.4 and 9 mm and, the most preferably, the inlet diameter of the capsule 6 is equal to 8.6 mm. Samely, the cross section at the top of the frustoconical shape of the capsule 6, i.e. the part of the capsule 6 connected to the vault 10, has a diameter which is preferably within the range of 7.5 to 8.5 mm, more preferably between 7.8 and 8.3 mm and, the most preferably, this top diameter is equal to 8 mm.

The outer size of the capsule 6 is generally of a cylindrical shape and its diameter is preferably within the range of 5 to 15 mm, more preferably between 7 and 12 mm, and the most preferably, this outer diameter in equal to 10 mm.

The depth of the capsule 6 is provided for always containing the incandescent portion of a cigarette-end and causing it to be extinguished by lack of oxygen.

In this respect the depth of the capsule 6 is preferably within the range of 5 to 15 mm, more preferably between 7 and 12 mm and, the most preferably, the depth of the capsule 6 is equal to 10 mm.

In addition to the foregoing, it is advantageous that the inner wall assembly, that is the wall 9 and vault-shaped wall 10, is polished, the effect of this feature being to make the extinction easier by providing a total tightness between a periphery of the cigarette and that of the wall. Actually, the polished state of the wall, added to the particular shape of the vault, provides for compaction of the incandescent portion of the cigarette by squeezing and compressing the incandescent portion, thereby avoiding thereafter a scattering of the ashes after extinction.

Moreover, the polished aspect of the whole wall prevents the ashes from adhering thereto when the cigarette is extinguished, which enables having always a clean capsule, and in any case a capsule which can be easily cleaned and having an efficiency which is not reduced as would be the case if the wall was partly coated with a layer of adhering soots or ashes.

Figure 4:
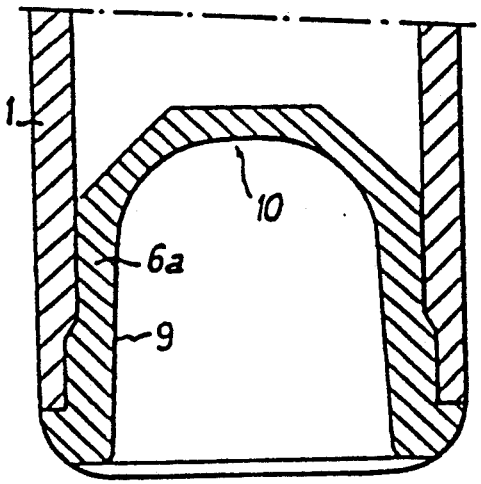
FIG. 4 is a cross sectional view similar to FIG. 3, illustrating a variant of embodiment.

FIG. 4 shows an alternative embodiment according to which a capsule 6*a* is formed so as to be directly adaptable to the body 1 of a cigarette-lighter without interposition of the insert 5*a* of FIG. 3. In this case, the capsule 6*a* is formed of a preferably moulded piece having a configuration such that it can be directly adapted to the inner wall of the body 1 of the cigarette-lighter and preferably made in only one step with the body 1. The capsule 6*a* can be made of a moulded metal, but also of a moulded synthetic material, or formed in any other manner as long as the material forms a smooth and polished inner wall 9, 10. In this respect the capsule 6*a*, as well as the capsule 6 of FIG. 3, can be made of the same plastics material as the body 1 fo the cigarette lighter, and particularly of a resin or polymer having self-extinguishing properties which can possibly be charged with additives, and typically with glass fibers. A product which been satisfactorily used is a polyamide 6-6 having a melting point temperature of 255° C. under self extinguishing standards UL 94 or ASTM D 635, and is marketed particularly by Dupont de Nemours and Rhone Poulenc under the respective names of TECHNYL A 221 and ZYTEL 135 F.

It has actually been found that the capsule was practically not heated when extinguishing a cigarette due to the rapidity with which the extinction takes place, this being caused by the tightness reached almost instantaneously between a cigarette and the wall of the capsule.

It is really quite surprising that the incandescent tip of a cigarette, which is clearly at a very high temperature, is extinguished so quickly that the capsule 6, 6*a* can even be formed of plastics.

Figure 5:
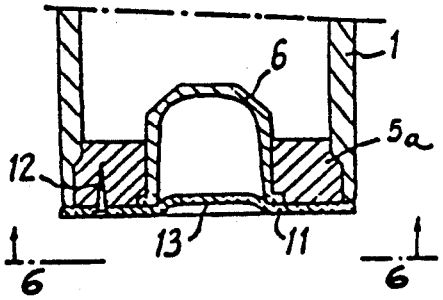
FIG. 5 is a cross sectional view taken substantially along line 5—5 of FIG. 1.

FIG. 5 shows a development of the invention according to which a small plate 11 is fixed to the bottom 5 of the cigarette-lighter by means of a pin 12.

The small plate 11 is advantageously formed with a concavity 13 in register with inlet of the capsule 6.

The small plate 11 is made of a flexible material, for example aluminum or a synthetic material and, in this manner, the concave portion 13 of the small plate 11 provides for a slight locking when brought in register with the inlet of the capsule 6. Opening of the small plate 11 by pivoting the small plate 11 about the pin 12, as shown schematically in phantom lines in FIG. 6, causes a resilient deformation of the small plate 11, which thereafter facilitates a return of the small plate 11 to its initial position by a simple push, and again a new locking of the small plate 11 in position.

Figure 7:
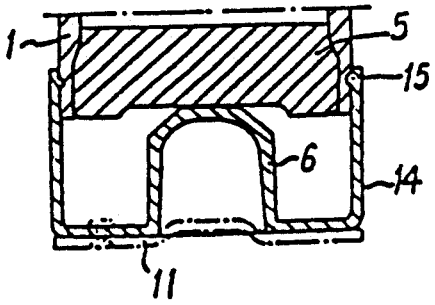
FIG. 7 is a cross sectional view similar to FIG. 5 of another variant of embodiment.

As it results from the hereabove described examples, the portion forming the extinguisher assembly is integral with the cigarette-lighter. However, and as shown in FIG. 7, this portion can be a separate part snapingly engaged on the body 1 of the cigarette-lighter. In such a case, the capsule 5 is formed from an envelope 14 adapted for encompassing the lower edge of the body 1 of the cigarette-lighter and is snapingly locked thereon by locking means 15, made for example of lugs ended by a protrusion cooperating with a recess formed at the base of the body 1.

The envelope 14 can be made of a dished or moulded metal or, as described in the foregoing disclosure, of a synthetic material.

Figure 6:
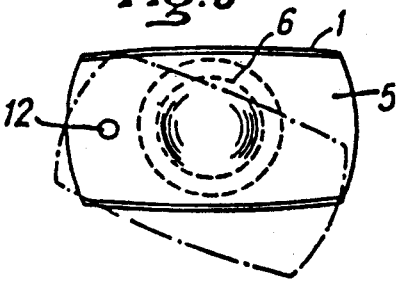
FIG. 6 is an elevation view taken substantially along line 6—6 of FIG. 5.

Also and as in FIGS. 5 and 6, it is possible to fix a small plate 11 (shown in phantom) if it is desired to close the capsule 5.

The invention is not limited to the embodiments shown and described in detail and various modifications thereof can be carried out thereto without departing from the scope of the invention as shown in the appendent claims, particularly since the present cigarette-ligther is a perfect and complete response to all the criteria mentioned above and it is the only one which has retained the attention of manufacturers. Indeed, it is clear that:

(a) The addition of the extinguishing capsule to a cigarette-lighter costs at most but a few cents and is adapted to automation.

(b) The volume taken from the fuel chamber is very small.

(c) The extinction of the cigarette takes only 2–3 seconds, and the container does not have time to become hot. This is obtained by the shape of the capsule and by its polished surface which begins to squeeze and compact the sides of the cigarette adjacent the lighted tip before the incandescent tip becomes compacted.

(d) The depth of the capsule is only 5–15 mm, and in practice does not exceed 10 mm.

(e) The manufacture at the industrial level is demonstrated by the sample concurrently filed.

I claim:

1. A cigarette lighter forming a cigarette extinguisher comprises a capsule defining a cup-shaped recess having an inner wall of frustoconical revolution constituting means to cause a squeezing and compaction of initially incandescent portion of a cigarette in order to prevent a scattering of ashes after extinction, said capsule ending into a substantially hemispherical vault, said substantially hemispherical vault comprising spherical sectors connected by a plane portion, said inner wall of said capsule being polished and having at least one cross section diameter corresponding substantially to that of a cigarette, and said capsule being fixedly connected to a bottom of a body of said cigarette-lighter and having a depth of 5–15 mm.

2. A cigarette-lighter as set forth in claim 1, having an inlet for said inner wall which is of a rounded shape.

3. A cigarette-lighter as set forth in claim 2, wherein said rounded shape has a radius which is within the range of 0.2 to 1 mm.

4. A cigarette lighter as set forth in claim 3, wherein said radius of said rounded shape is between 0.4 and 0.8 mm.

5. A cigarette lighter as set forth in claim 3, wherein said radius of said rounded shape is equal to 0.5 mm.

6. A cigarette-lighter as set forth in claim 1, wherein said spherical sectors have each a radius which is within the range of 3 to 4 mm.

7. A cigarette-lighter as set forth in claim 6, wherein said radius of said spherical sector is between 3.4 and 3.8 mm.

8. A cigarette-lighter as set forth in claim 6, wherein said radius of said spherical sector is equal to 3.5 mm.

9. A cigarette-lighter as set forth in claim 1, wherein said spherical sectors have each a center, with said centers of said spherical sectors being spaced apart by a distance which is within the range of 0 to 1.8 mm.

10. A cigarette-lighter as set forth in claim 9, wherein said centers of said spherical sectors are spaced apart by a distance which is between 0.5 and 1.5 mm.

11. A cigarette-lighter as set forth in claim 9, wherein said centers of said spherical sectors are spaced apart by a distance which is equal to 1 mm.

12. A cigarette-lighter as set forth in claim 1, wherein said capsule is connected to said body of said cigarette-lighter by an insert protruding beyond a lower portion of said capsule.

13. A cigarette-lighter as set forth in claim 12, wherein said insert is made of a heat insulating material.

14. A cigarette-lighter as set forth in claim 1, wherein said capsule forms directly said bottom of said body of said cigarette-lighter.

15. A cigarette-lighter as set forth in claim 1, wherein said capsule is connected to said body of said cigarette-lighter by an envelope, said envelope being provided with locking means.

16. A cigarette-lighter as set forth in claim 1, further comprising a flexible small plate, said small plate being formed with a concavity and resiliently engaged inside said capsule and supported by a pin.

17. A cigarette-lighter as set forth in claim 1, wherein said capsule is made of metal.

18. A cigarette-lighter as set forth in claim 1, wherein said capsule is made of synthetic resin.

19. A cigarette-lighter as set forth in claim 1, wherein said inner wall of said capsule has a conical shape chosen so as to meet with diameter difference of cigarettes of different brands.

20. A cigarette-lighter as set forth in claim 1, wherein said inner wall of said capsule has an inlet diameter which is within the range of 8 to 9.5 mm.

21. A cigarette-lighter as set forth in claim 20, wherein said inlet diameter is between 8.4 and 9 mm.

22. A cigarette-lighter as set forth in claim 20, wherein said inlet diameter is equal to 8.6 mm.

23. A cigarette-lighter as set forth in claim 19, wherein said inner wall of said capsule has a cross section at top of said frustoconical revolution shape which has a diameter which is within the range of 7.5 to 8.5 mm.

24. A cigarette-lighter as set forth in claim 23, wherein said top diameter is between 7.8 and 8.3 mm.

25. A cigarette-lighter as set forth in claim 23, wherein said top diameter is equal to 8 mm.

26. A cigarette-lighter as set forth in claim 1, wherein said capsule has an outer wall which is generally of a cylindrical shape with an outer diameter which is within the range of 5 to 15 mm.

27. A cigarette-lighter as set forth in claim 26, wherein said outer diameter is between 7 and 12 mm.

28. A cigarette-lighter as set forth in claim 26, wherein said outer diameter is equal to 10 mm.

29. A cigarette-lighter as set forth in claim 1, wherein said capsule is provided with a flange of an outer diameter which is within the range of 8 to 15 mm.

30. A cigarette-lighter as set forth in claim 29, wherein said outer diameter of said flange is between 9.5 and 13 mm.

31. A cigarette-lighter as set forth in claim 29, wherein said outer diameter of said flange is equal to 11 mm.

32. A cigarette-lighter as set forth in claim 1, wherein said capsule is provided with a flange of a thickness which is substantially equal to a general thickness of said capsule and is within the range of 0.5 to 2 mm.

33. A cigarette-lighter as set forth in claim 32, wherein said general thickness is between 0.8 and 1.5 mm.

34. A cigarette-lighter as set forth in claim 32 wherein said general thickness is equal to 1 mm.

35. A cigarette-lighter as set forth in claim 1, wherein said depth of said capsule is comprised between 7 and 12 mm.

36. A cigarette-lighter as set forth in claim 35, wherein said depth is equal to 10 mm.

37. A cigarette-lighter as set forth in claim 1, wherein said capsule is made of plastics material identical to a plastics material used for molding said body of said cigarette-lighter.

38. A cigarette-lighter as set forth in claim 37, wherein said plastics material is a resin or polymer having self-extinguishing properties.

39. A cigarette-lighter as set forth in claim 38, wherein said resin or polymer is charged with additives, typically glass fibers.

40. A cigarette-lighter as set forth in claim 38, wherein said resin or polymer is a polyamide 6-6.

41. A cigarette-lighter as set forth in claim 1, wherein said capsule is integral with said body and forms a single unit.

* * * * *